US005239143A

United States Patent [19]

Valenzona

[11] Patent Number: 5,239,143

[45] Date of Patent: Aug. 24, 1993

[54] ROCKER SWITCH OPERATOR MEANS

[75] Inventor: Joseph Valenzona, La Mirada, Calif.

[73] Assignee: Judco Manufacturing, Inc., Harbor City, Calif.

[21] Appl. No.: 212,717

[22] Filed: Jun. 28, 1988

[51] Int. Cl.[5] ..... H01H 27/00

[52] U.S. Cl. ..... 200/43.04; 200/43.16; 200/339

[58] Field of Search ..... 200/43.01, 43.02, 43.04, 200/43.16, 339

[56] References Cited

U.S. PATENT DOCUMENTS

| | | | |
|---|---|---|---|
| 3,632,914 | 1/1972 | Osika | 200/43.01 |
| 4,168,416 | 9/1979 | Josemans | 200/43.04 |
| 4,230,917 | 10/1980 | Osika | 200/43.01 |
| 4,440,994 | 4/1984 | Nat | 200/43.04 |
| 4,463,228 | 7/1984 | Osika | 200/43.02 |
| 4,705,920 | 11/1987 | Sahrbacker | 200/43.04 |

*Primary Examiner*—Charles E. Phillips
*Assistant Examiner*—Glenn T. Barrett
*Attorney, Agent, or Firm*—G. Norden Hanover

[57] ABSTRACT

An improved operator assembly for a rocker switch having a switch contact member movable relative to fixed contacts. Movement of an inner rocker moves the switch contact to turn the switch on and off. An outer rocker is located adjacent the inner rocker. The rockers are normally coupled by an inserted safety key for common movement. The rockers include stop components interengagable when the outer rocker is moved manually without a key toward a position corresponding to the off position of the switch, for example. The stop components are not interengagable when the outer rocker is moved toward a position which would turn the switch on. With this arrangement, when the key is removed with the switch on, the outer rocker can be manually operated to turn off the switch. However, if the switch is off, manual operation of the outer rocker in the opposite direction will not be accompanied by movement of the inner rocker and consequently the switch cannot be turned on. The position of the inner rocker is reversible so that the opposite function can be achieved, that is, the outer rocker can then be operated to turn on a switch that is off, but it cannot be operated to turn off a switch that is on.

14 Claims, 2 Drawing Sheets

ROCKER SWITCH OPERATOR MEANS

BACKGROUND OF THE INVENTION

1. Field of the Invention

The present invention relates to operator means for moving the movable contact of a rocker switch, and more particularly to an operator means which requires use of a removable safety key to move the contact.

2. Description of the Prior Art

Safety key operated rocker switches are widely used in conjunction with power tools such as table saws, band saws, drill presses and the like. An elongated member or key must be inserted to turn on the switch and usually it cannot be removed once the switch is on. This is intended to prevent use of the tool by an unauthorized person who does not have access to the key, but unfortunately it does not provide complete protection against one who is intent on defeating the safety feature. Even authorized operators are tempted to circumvent the key requirement when they lose or misplace their key.

It is possible to operate a safety key type of rocker switch by inserting a small "cheater" tool such as a screwdriver in the opening that usually receives the key. The screwdriver can then be used to turn on the switch in the same manner as a key would have done. However, this method of defeating the key requirement presents a dangerous operating condition. Once the switch is on, the cheater tool is usually set aside. Thereafter, if an emergency arises and the operator needs to turn off the switch in a hurry, the tool first has to be located and then reinserted before that can be done. It may well be that if the operator's clothing is caught in the power tool, for example, the operator is in a panic, probably cannot reach the cheater tool, and even if it can be reached it cannot be inserted in time to prevent injury to the operator.

It is very nearly impossible to provide an inexpensive means for rendering a rocker switch inoperable once the operating key is removed. What is needed is an operator means which, if actuated by a foreign object or cheater tool to turn on the switch, can nevertheless be actuated at any time to turn the switch off without a key or tool of any kind.

SUMMARY OF THE INVENTION

The present invention comprises an improved operator means normally utilizing an insertable key to turn a rocker switch on or off, which prevents key removal in the switch on position, but which enables the switch to be turned off without the key in an emergency or the like.

The operator means includes an inner rocker whose movement is imparted to a movable switch contact to turn the switch on end off. An outer rocker is located adjacent the inner rocker. Both rockers include stop means which are interengaged when the outer rocker is moved in one direction, but disengaged when the outer rocker is moved in the opposite direction. With this arrangement, if the switch is off, for example, movement of the outer rocker in a direction which disengages the stop means would be ineffective to move the inner rocker and thereby turn on the switch. However, if the switch is on, movement of the outer rocker in the opposite direction interengages the stop means so that the inner rocker is moved with the outer rocker to turn off the switch.

The inner and outer rockers include alignable recesses and openings to receive a safety key so that the key will couple together and move the inner and outer rockers in unison. This enables use of the key in normal operation of the switch to turn it on or off, as desired.

The switch housing which contains the switch components includes a retainer means which captures the safety key and prevents its removal when the key is in its on position. However, the retention means is inoperative in the switch off position of the key to enable the key to be removed.

The present operator means is thus capable of providing all of the usual functions of a key operated rocker switch of the prior art, but it has the additional feature that the switch can be turned off without a key.

If desired, the position of the components of the inner rocker can be reversed so that the stop means is oppositely located. The operation of the operator means remains essentially the same, except that when the switch is off, it can be turned on without a key. However, when it is on it cannot be turned off without a key. This system is useful in applications such as computers where it is sometimes desirable to allow an operator to turn on the computer without a key, but undesirable to allow the computer to be turned off without a key. Premature turn off of a computer could result in the loss of important data.

The actuator means and rocker switch of the invention are relatively inexpensive to manufacture, easy to assemble, and include a number of parts which can be reversed in position without adversely affecting their function. Although the actuator means has particular application to rocker switches, it is also useful in various other switch applications in which the switch is characterized by a movable switch arm or tab for operating a switch contact through intermediate or linking switch components.

The components of the operator means and the associated rocker switch components are preferably injection molded of resilient plastic material having thicknesses or wall sections in predetermined areas to render the various components capable of snap fitting together without the use of assembly clips, fasteners or the like.

Other objects and features of the invention will become apparent from consideration of the following description taken in connection with the accompanying drawings.

DESCRIPTION OF THE PREFERRED EMBODIMENTS

The particular rocker switch with which the operating means of the present invention is associated 4 comprises an injection molded, electrically insulating housing means or assembly 10 made of plastic material having a limited degree of resilience to facilitate assembly, as will be seen. The housing assembly includes an outer housing 12 having an internal downwardly opening switch cavity which receives an inner housing 14.

Figure 1:
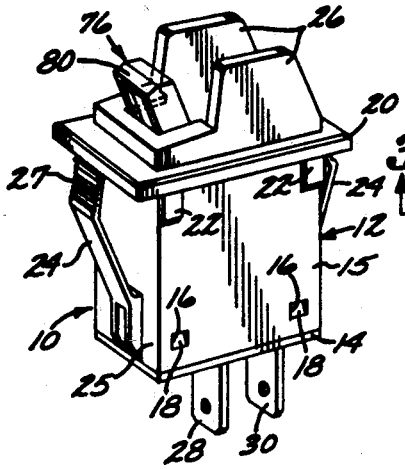
FIG. 1 is a perspective view of a rocker switch incorporating the operating means of the present invention.
Figure 2:
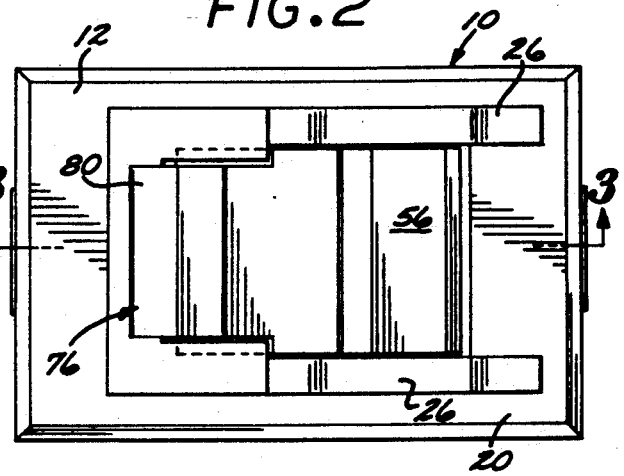
FIG. 2 is an enlarged top plan view of the rocker switch of FIG. 1.

The outer housing is generally rectangular in horizontal cross section, as viewed in FIG. 1, having opposite side walls 15 and end walls 25. The side walls 15 include detent openings 16, a pair of which are seen in the side wall 15 illustrated in FIG. 1. The horizontal cross section of the inner housing is similarly generally rectangular, and includes side walls 17 and end walls 19 complemental to the outer housing side and end walls 15 and 25. The inner housing end walls serve as actuation stops to limit movement in opposite directions of an inner rocker and an outer rocker, as will be seen.

The inner housing side walls have complemental projecting wedge-shaped detents 18, and the inner and outer housings are so dimensioned that upon assembly of the switch the resilient nature of the plastic material of which the housings are formed allows the detents 18 to closely engage and slide over the inner surfaces of the outer housing side walls 15, and then snap fit within the detent openings 16 to securely hold the inner housing in place.

The upper portion of the outer housing includes a peripheral flange 20, and thickened sections 22 in the walls 15 adjacent the flange. The outer housing further includes a pair of arms 24 integral with the walls 25 of the outer housing, and projecting upwardly to the flange 20. The middle portions of the arms are spaced from the walls 25, and the arm portions adjacent the flange 20 include serrations 27. The serrated arms 24 and thickened sections 22 tend to yield and compress slightly, respectively, when the switch is inserted into an opening in a mounting panel (not shown) to hold the switch securely in position, with the flange 20 resting upon the margins of the opening.

The upper extremity of outer housing 12 includes upstanding, transversely spaced apart sections which serve as palm guards 26. They are located on opposite sides of the safety key which turns the switch on and off. When the key is in its off position it is located between the guards 26 so that it cannot be accidentally operated by brushing against it. Instead, the operator must consciously place a finger between the guards in order to move the key from the off position to the on position of FIG. 1.

Figure 3:
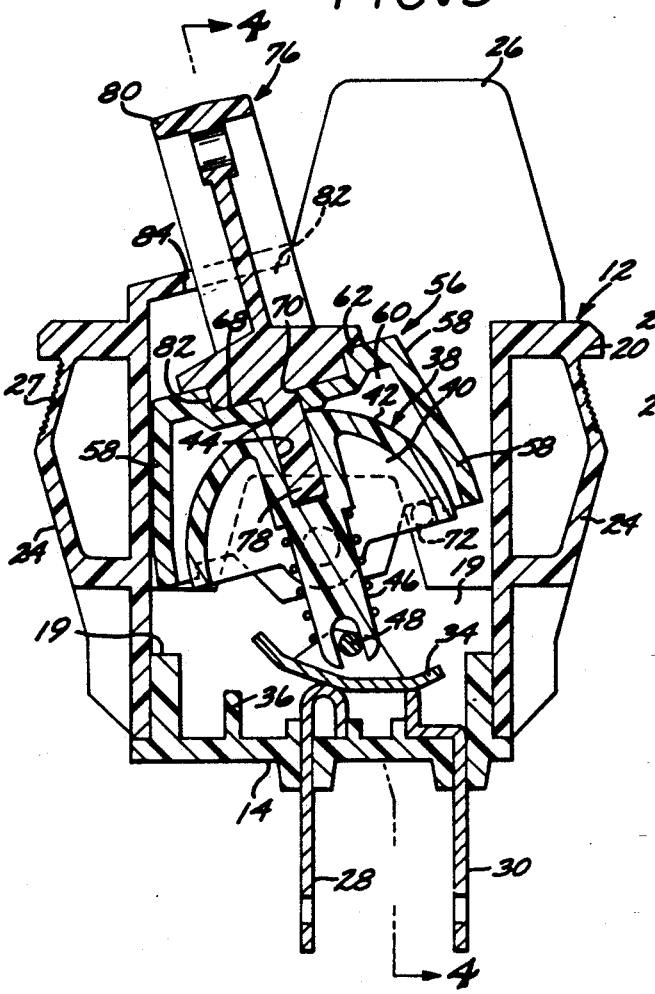
FIG. 3 is an enlarged view taken along the line 3—3 of FIG. 2.
Figure 5:
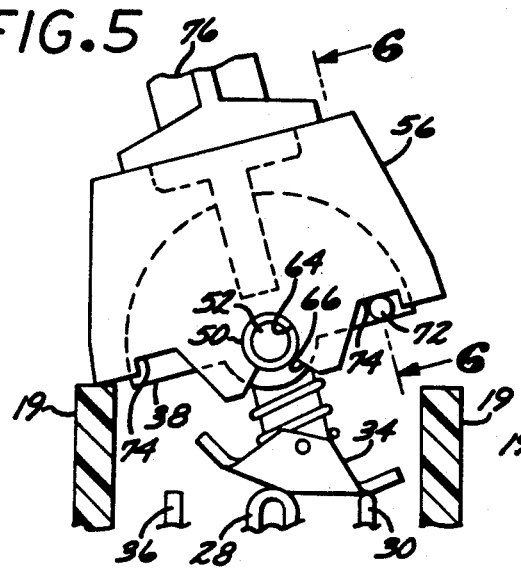
FIG. 5 is a diagrammatic view showing the relative locations of the safety key, outer and inner rockers, and the movable and fixed contacts in the on position of one version of rocker switch.
Figure 7:
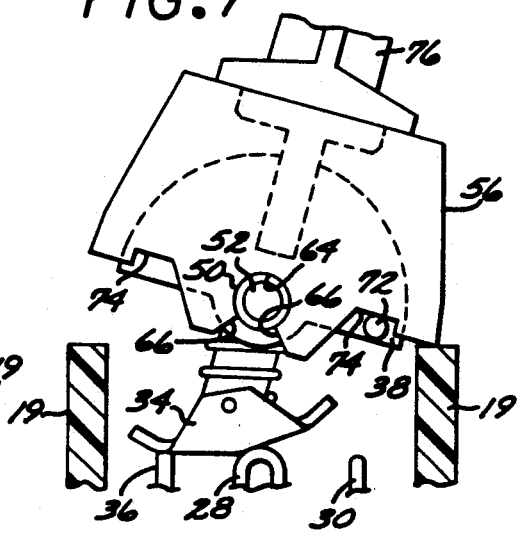
FIG. 7 is a view similar to FIG. 5 but illustrating the components in the off position of the switch.
Figure 6:
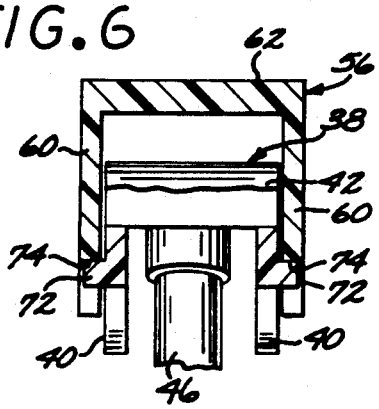
FIG. 6 is a view taken along the line 6—6 of FIG. 5.

The inner housing includes electrically conductive contacts comprising a central contact 28 and an end contact 30 and a movable contact 34 for electrically bridging or completing a circuit between the contacts 28 and 30. Reference is made to my copending U.S. patent application Ser. No. 7/075,525, filed Jul. 20, 1987 for a more detailed description of the operation of a prior art rocker switch having such a movable contact to establish an on condition of the switch as seen in FIGS. 3 and 5, or an off condition, as seen in FIG. 7.

The movable contact 34 is configured for sliding or wiping movement across the rounded central contact 28, with an accompanying pivotal movement about a pivot shaft 48. Thus, as one extremity of the contact 34 disengages end contact 30 and moves across the central contact 28, the opposite extremity of the contact engages an upright post 36 molded integral with the base of the inner housing 14. This is the off position of the switch.

Movement of the contact 34 between its off and on positions is accomplished by the operator means of the present invention which comprises, generally, an inner rocker 38, an outer rocker 56 and a safety key 76.

The inner rocker includes a generally semi-cylindrical upper portion defined by side walls 40 which are integral with a semi-cylindrical middle wall 42. The wall 42 includes a depending central section which, with the side walls 40, defines a key recess 44.

An elongated member or shaft 46 which is formed integral with the key recess central section extends oppositely of the recess toward the interior of the housing. It terminates in an inner extremity having a slot which loosely accepts the pivot shaft 48 of the movable contact. A compression spring is disposed about the shaft 46 and exerts its bias at one end against the movable contact and at its other end against a shoulder of the inner rocker shaft 46.

The inner rocker side walls 40 include laterally projecting trunnions which each have a larger diameter inner portion 50 and a smaller diameter outer portion 52. The trunnion outer portions are carried within trunnion apertures 54 provided in the adjacent opposite side walls of the inner housing 14 for pivotal movement of the inner rocker about a rocker axis extending through the trunnions. The pivotal movement of the inner rocker relative to the housing assembly is between positions corresponding to the on and off positions of the movable contact.

The resilient plastic material of the inner housing and the inner rocker enables the inner rocker trunnions to be slid along the inner surfaces of the inner housing side walls until they snap fit within the trunnion apertures 54. When properly located in the manner illustrated, pivotal movement of the inner rocker moves the movable contact 34 between the on and off positions illustrated in FIGS. 5 and 7, respectively, with the compression spring providing sufficient bias to insure good sliding electrical contact between the movable contact and the fixed contacts.

The outer rocker 56 is also generally rectangular in horizontal cross section, having opposite end walls 58, opposite side walls 60, an upper wall 62 and an open lower portion through which the inner rocker is disposed for receipt within the hollow interior of the outer rocker. There is sufficient clearance between the rockers so that they are rotatable relative to one another about the rocker axis defined by the inner rocker trunnions.

The side walls 60 of the outer rocker include depending portions having trunnion openings 64 characterized by a diameter approximating the diameter of the larger diameter trunnion portions 50 of the inner rocker. The trunnion openings 64 each include a downwardly opening narrower throat or entry portion 66 which, by virtue of the resilient character of the plastic material of which the outer rocker is made, is yieldable to permit the entry portions to be forced past the larger diameter trunnion portions 50 to snap fit the outer rocker onto the portions 50 and into position for pivotal movement of the outer rocker relative to the trunnion portion without any need for additional fastening clips or the like.

The upper wall 62 includes a generally rectangular downwardly offset seat 68 which includes a transverse key slot 70 alignable with inner rocker key recess 44 when the rockers are in the relative positions illustrated in FIG. 3, 5 and 7.

Figure 4:
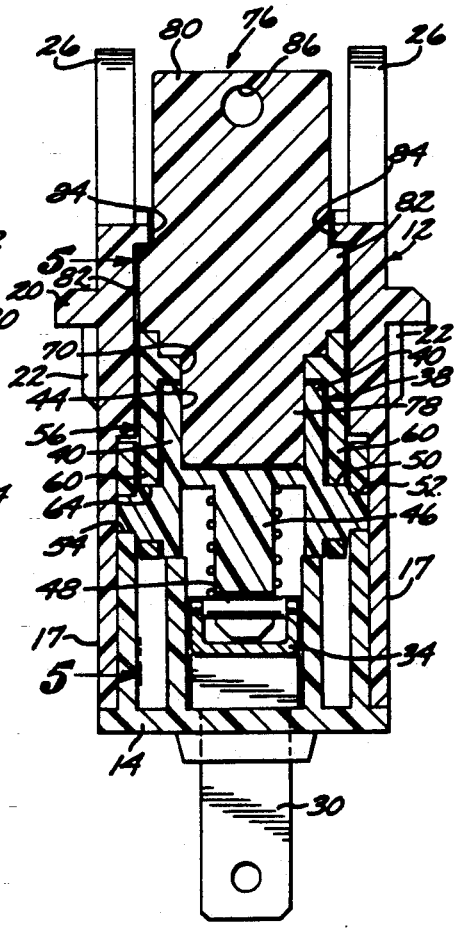
FIG. 4 is a view taken along the line 4—4 of FIG. 3.

The permissible movement in opposite directions of the inner and outer rockers is limited by their alternate engagement with the actuation stops or the inner housing end walls 19, as will be apparent from an examination of FIGS. 3 and 4.

Figure 8:
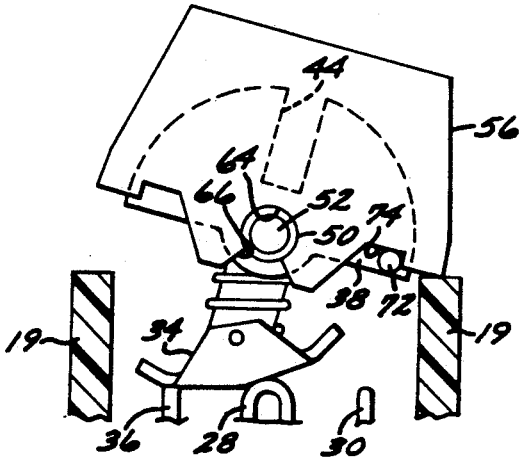
FIG. 8 is a view similar to FIG. 5, without the key, and illustrating how movement of the outer rocker in a clockwise direction is effective to also move the inner rocker from the position of FIG. 5 to that of FIG. 8 to turn the switch off.
Figure 10:
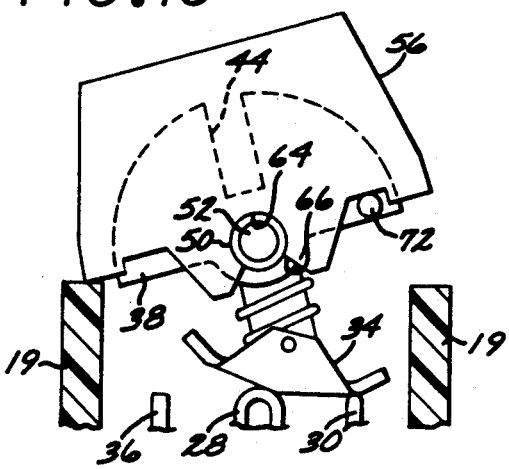
FIG. 10 is a view similar to FIG. 8, but illustrating the components in the switch on position, and showing the interengagement between the inner and outer rockers which is effective to turn the switch off upon manual actuation of the outer rocker.

An important feature of the inner and outer rockers is a stop means which enables the outer rocker to move the inner rocker with it when it is rotated from the switch on position of FIG. 10 to the switch off position of FIG. 8. However, the stop means is ineffective to move the inner rocker with the outer rocker when the outer rocker is moved in the opposite direction from the switch off to the switch on position.

The stop means in the embodiment illustrated includes a pair of stop posts 72 integral with and extending laterally of the inner rocker side walls 40. The stop posts are located on the right side of the rocker axis, as seen in the various illustrations, to enable the outer rocker to move the inner rocker from the on position of FIG. 10 to the off position of FIG. 8. To accomplish this the lower edge of the outer rocker includes stop surfaces 74 engagable with the stop posts 72.

Figure 9:
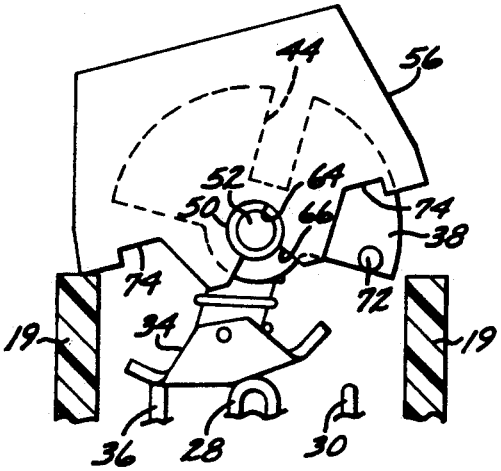
FIG. 9 is a view similar to FIG. 8, but illustrating how movement of the outer rocker in the opposite direction is ineffective to move the inner rocker, so that the switch remains off.

Although the stop surfaces 74 are located on both sides of the rocker axis, the inner rocker is provided with the stop posts 72 on only the right side of the rocker axis. Consequently, movement of the outer rocker from the position of FIG. 8 to that of FIG. 9 is ineffective to move the inner rocker and the movable contact to a switch on position.

If it were desired to make the outer rocker effective to move the inner rocker with it to a switch on position, and ineffective to move the inner rocker with it to a switch off position, the inner rocker would simply be reversed in position to locate the stop posts 72 on the side of the rocker axis opposite that which is illustrated. This is made possible because the outer rocker is made symmetrical with respect to a plane intersecting the rocker axis and passing through the center of the outer rocker. This symmetrical construction is also true of the safety key 76 and the inner rocker, expect for the provision of the stop posts 72.

It will be obvious that an equivalent stop means could be provided by placing the stop posts on the outer rocker and providing stop surfaces on the inner rocker, if desired. Likewise, location of the trunnions on the inner housing, with the trunnion openings provided in both the inner and outer rockers, instead of the arrangement described, could also be done, if desired. It is primarily necessary that the trunnion arrangement enable pivotal movement of the inner and outer rockers relative to one another and relative to the inner housing, and that the stop means enable movement of the outer rocker in one direction by itself but be accompanied by movement of the inner rocker when the outer rocker is moved in the opposite direction.

The arrangement just described is particularly valuable when the switch has been turned on with some foreign object or cheater tool instead of the usual safety key. In such a situation, if an emergency arises and the operator wishes to shut off the switch immediately, all he or she need do is manually engage and pivot the outer rocker from the position of FIG. 10 to that of FIG. 8. Use of the safety key that is normally used to move the inner and outer rockers in unison is not necessary.

The safety key 76 includes an inner or elongated coupler portion 78 which is configured to project inwardly through the key slot 70 and into the key recess 44. The outer portion of the key constitutes a switch member 80 which projects upwardly for location between the guards 26. The key also includes an intermediate, generally rectangular central portion 82 which fits within the outer rocker seat 68.

As best seen in FIG. 4, the key further includes a pair of laterally outwardly disposed side projections 82 which cooperate with flanges 84 integral with and extending laterally inwardly of the sides of the outer housing. The flanges 84 overlie the projections 82 of the key when the key is in the on position of FIG. 3, preventing it from being removed or separated. However, the pivot path defined by the flanges 84 is discontinuous and when the key is located in its off position between the palm guards 26, the key can be removed so that the switch is disabled except for those intent on using a cheater tool or the like.

The switch member 80 of the key preferably includes an opening 86 to accept a cord or tether (not illustrated) for attachment of the key to adjacent fixed structure so that the key cannot be lost or misplaced.

From the foregoing it is seen that the present operator means enables a usual safety key to be used to couple the inner and outer rockers to turn the switch on and off. The key cannot be removed when the switch is on, so it is normally immediately available to turn the switch off, particularly in an emergency. However, if the switch is turned on in an unauthorized manner by using a tool other than the key 76, and the tool is not available to turn the switch off, the outer rocker can still be pivoted manually to engage and carry the inner rocker with it to shut off the switch. Manual rotation of the outer rocker in the opposite direction will be unavailing to carry the inner rocker with it so that the switch cannot be turned on if it is in an off position.

Various modifications and changes may be made with regard to the foregoing detailed description without departing from the spirit of the invention.

I claim:

1. In a rocker switch that comprises a housing having oppositely disposed trunnions defining a rocker axis for pivotable movement, and a movable contact and fixed contacts disposed therein, an operator adapted to move the movable contact relative to the fixed contacts, the operator comprising:

an inner rocker having oppositely disposed trunnions coupled to the trunnions of the housing to provide for pivotal movement of the inner rocker relative to the housing between a first and a second position, and further having a shaft extending into the housing that is pivotably coupled to the movable contact to move it in response to movement of the inner rocker between its first and second positions, and further having a key recess therein;

an outer rocker having oppositely disposed trunnions coupled to the trunnions of the inner rocker to provide for pivotal movement of the outer rocker relative to the inner rocker between the first and second positions, and further having a key slot alignable with the key recess of the inner rocker;

a key having an elongated coupler portion adapted to project through the key slot and into the key recess and adapted to couple the inner and outer rockers together, and further having a switch member that projects away from the outer rocker and that is adapted to operate the rocker switch, and wherein the key is manually actuated by means of the switch member to pivot the inner and outer rockers in unison between the first and second positions, and wherein the key is manually removable from the key recess and key slot to uncouple the key therefrom; and stop means disposed asymmetrically with respect to the axis of rotation on the inner rocker and symmetrically with respect to the axis of rotation on the outer rocker that are interengagable on movement of the outer rocker toward its first position to move the inner rocker toward its first position, and that are disengageable on movement of the outer rocker from its first position toward its second position, whereby the inner rocker remains in its first position, and wherein the stop means disposed on the outer rocker are disposed symmetrically about the rocker axis and the stop means disposed on the inner rocker are disposed asymmetrically on the inner rocker on a first side of the rocker axis to cause the inner and outer rockers to move in unison toward the first position, and the outer rocker to move independently of the inner rocker when the outer rocker moves toward the second position.

2. The operator of claim 1 in which the inner rocker is reversible in position relative to the outer rocker and the housing to move the stop means to a second side of the rocker axis opposite the first side, thereby causing the inner rocker to move in unison with the outer rocker when the outer rocker moves toward the second position, and the outer rocker to move independently of the inner rocker when the outer rocker moves toward the first position.

3. The operator of claim 1 in which the stop means comprises a stop surface on the outer rocker and a stop posit projecting from the inner rocker in the path of pivotal movement of the stop surface.

4. The operator of claim 1 wherein the key is manually removable from the key recess and key slot to uncouple the key therefrom when it is disposed in the first position, and wherein the housing further includes retention means comprising spaced part, inwardly directed flanges that are adapted to engage the retention projections on the key to prevent removal thereof when it is in the second position, the rocker switch further comprising:

stop means disposed on the inner and outer rockers that are interengageable on movement of the outer rocker toward its first position to move the inner rocker toward its first position, and that are disengagable on movement of the outer rocker from its first position toward its second position, whereby the inner rocker remains in its first position.

5. The operator of claim 1 in which the housing comprises an outer housing having retention means and further having opposite walls formed with detent openings, and in which the housing further comprises an inner housing including opposite walls having outwardly projecting detents adapted to tightly fit and slide across the inner surfaces of the opposite walls of the outer housing for forcible engagement within the detent openings for retention of the inner housing within the outer housing, and wherein the inner housing further comprises trunnion apertures adapted to receive the trunnion shafts of the inner rocker for support of the operator.

6. The operator of claim 11 in which the key and the outer rocker are each symmetrical with respect to a place that includes the rocker axis and the center line of the key and outer rocker, whereby the key and the outer rocker may be reversed in position without change in the switch operation.

7. The operator of claim 11 in which the housing has opposing sidewalls and in which the trunnions of the housing comprises trunnion apertures integrally formed within the sidewalls, and wherein the trunnions of the inner rocker comprise trunnion shafts having smaller diameter outer portions fitting within the trunnion apertures, and further having larger diameter portions, and wherein the trunnions of the outer rocker comprise circular trunnion openings have a predetermined diameter adapted to receive the larger diameter portions of the trunnion shafts.

8. The operator of claim 7 in which the outer rocker includes two opposing walls containing the trunnion openings and wherein the trunnion openings include narrower entry throats adapted to forcibly engage the large diameter portions of the trunnion shafts.

9. In a rocker switch operating on an external electrical circuit, wherein the switch includes a movable contact coupled to fixed contacts and wherein the fixed contacts couple between the movable contact and the electrical circuit, an improved operator for moving the movable contact relative to the fixed contacts, the operator comprising:

an inner housing having a base supporting the fixed contacts, and including oppositely disposed sidewalls having therein oppositely disposed oppositely disposed trunnion apertures defining a rocker axis, the sidewalls further having outwardly projection detents;

an inner rocker having oppositely disposed trunnion axles coupled to the trunnion apertures of the inner housing to provide for pivotal movement between a first and a second position of the inner rocker relative to the inner housing, and further having a shaft extending towards the base of the inner housing that is pivotably coupled to the movable contact to move it in response to movement of the inner rocker between its first and second positions, and further having a key recess therein;

an outer rocker having oppositely disposed trunnion openings coupled to the trunnion axles of the inner rocker to provide for pivotal movement between the first and second positions of the outer rocker relative to the inner rocker and the inner housing, and further having a key slot alignable with the key recess of the inner rocker;

a key having on one side an elongated coupler portion adapted to project through the key slot and into the key recess thereby coupling the inner and outer rockers together, and further having a switch member that projects away from the outer rocker that is adapted to manually operate the rocker switch, the outer portion of the switch member having smaller dimensions that the inner portions thus forming laterally and oppositely disposed retention shoulders, and wherein the key is manually actuatable by means of the switch member to pivot the inner and outer rockers in unison between the first and second positions, and wherein the key is manually removable from the key recess and key slot to uncouple the key therefrom when it is disposed in the first position; and an outer housing having opposite sidewalls adapted to slideably fit over the inner housing, and having detent openings therein for engaging the dents of the inner housing walls during switch assembly, and having external projections adapted to couple to external mounting means, the outer housing further having a key opening through which the outer portion of the switch member of the key may protrude allowing manual actuation of the switch.

10. The operator of claim 9 in which the key opening of the outer housing is smaller than the retention shoulders of the switch member.

11. The operator of claim 10 in which the key opening is formed by laterally inwardly directed flanges forming a pivot path defined by the key retention shoulders.

12. The operator of claim 11 whereby the flanges terminate in a position corresponding to the first positions of the outer rocker whereby the key is separable from the outer housing when it is disposed in the first position.

13. In a rocker switch that includes a housing having oppositely disposed trunnions, and containing a movable contact and fixed contacts, an improved operator for moving the movable contact relative to the fixed contacts, the operator comprising:

an inner rocker having oppositely disposed trunnions operatively coupled to the trunnions of the housing for pivotal movement of the rocker relative to the housing about a rocker axis, and between a first position and a second position, and further having a shaft extending interiorly of the housing and terminating in an inner extremity that is pivotally coupled to the movable contact to move the movable contact in response to movement of the inner rocker between its first and second positions, and further having a key recess which opens oppositely of the shaft;

an outer rocker having oppositely disposed trunnions operatively coupled to the trunnions of the inner rocker for pivotal movement of the outer rocker relative to the inner rocker about the rocker axis, and between the first and second positions, and further having a key slot alignable with the key recess of the inner rocker in a predetermined pivoted position of the outer rocker relative to the inner rocker;

a key including an elongated coupler portion for projection inwardly through the key slot and receipt within the key recess, and further including a switch member for projection outwardly of the outer rocker, in which position of the key the switch member is manually actuable to pivot the inner and outer rockers in unison between the first and second positions, the key being manually separable from the inner and outer rockers to enable manual actuation of the outer rocker;

and wherein the housing and the key include retention means for preventing disengagement of the key from the inner and outer rockers upon location of the inner and outer rockers in the second position, the housing including transversely spaced apart, laterally inwardly directed flanges defining a pivot path, the key including laterally oppositely directed projections for receipt inwardly of the flanges wherein the key is not separable from the housing at any point along the pivot path; and stop means disposed on the inner and outer rockers that are interengagable on movement of the outer rocker toward its first position to move the inner rocker toward its first position, the stop means being disengageable on movement of the outer rocker from its first position toward its second position whereby the inner rocker remains in its first position, and wherein the stop means disposed on the outer rocker are disposed symmetrically about the rocker axis and the stop means disposed on the inner rocker are disposed asymmetrically on the inner rocker on a first side of the rocker axis to cause the inner and outer rockers to move in unison toward the first position, and the outer rocker to move independently of the inner rocker when the outer rocker moves toward the second position.

14. The operator of claim 13 wherein the flanges terminate at a position corresponding to the first position of the outer rocker, and wherein the key is separable from the housing when it is disposed in the first position.

* * * * *